United States Patent [19]

Langhoff et al.

[11] Patent Number: 4,508,542

[45] Date of Patent: Apr. 2, 1985

[54] SLAG SEPARATOR FOR A COAL GASIFICATION INSTALLATION

[76] Inventors: Joseph Langhoff, Kleinbergerhof 10, 4220 Dinslaken; Erwin Althoff, An der Dorndelle 7, 4619 Bergkamen; Wolfgang Kolodzey, Koloniestr. 57, 4100 Duisburg; Ulrich Gerhardus, Im Terfreen 4, 4200 Oberhausen, all of Fed. Rep. of Germany

[21] Appl. No.: 562,042

[22] Filed: Dec. 16, 1983

Related U.S. Application Data

[63] Continuation of Ser. No. 230,741, Feb. 2, 1981, abandoned.

[51] Int. Cl.[3] ..... C10J 3/52

[52] U.S. Cl. ..... 48/77; 48/69; 48/DIG. 2; 110/171; 209/158

[58] Field of Search ..... 48/77, 69, 87, DIG. 2, 48/DIG. 7, 197 R; 110/165 R, 165 A, 167, 171; 209/158–161, 210

[56] References Cited

U.S. PATENT DOCUMENTS

| | | | |
|---|---|---|---|
| 1,456,563 | 5/1923 | Noriega | 209/161 |
| 3,971,638 | 7/1976 | Matthews | 48/197 R |
| 3,976,443 | 8/1976 | Paull et al. | 48/197 R |
| 4,074,981 | 2/1978 | Slater | 48/197 R |

*Primary Examiner*—Peter Kratz

*Attorney, Agent, or Firm*—Nils H. Ljungman

[57] ABSTRACT

In a coal gasification installation having a gasifier reactor and a water bath at the bottom of the gasifier reactor, a mixture of water and slag particles removed from the water bath is admitted under pressure into a container full of water and having a partition member for separating the heavier slag particles entrained to the bottom of the container from the lighter particles allowed on its opposite side to rise and float. A dam at the surface of the water in the container retains the floating particles while the clean water flows over the dam to an outlet. The floating particles which may be collected inside the container or entrained through a second outlet, are filtered and classified. Filtering is effected with a drum filter; and when several such filters are used in cascade, the slag particles are classified for recycling.

3 Claims, 8 Drawing Figures

SLAG SEPARATOR FOR A COAL GASIFICATION INSTALLATION

BACKGROUND OF THE INVENTION

The application is a continuation of Ser. No. 230,741 (now abandoned) filed on Feb. 2, 1981. The invention pertains to a coal gasification installation including a gasification reactor and a water bath disposed inside the reactor, or inside a waste heat boiler adjacent to the reactor. Slag accumulating in the water bath is tapped and discharged with the water from the reactor or waste heat boiler.

The falling slag which has become mixed with the water causes a serious problem of evacuation in a gasification installation. Slag evacuation, though, is of definite importance for a fully satisfying commercial operation of the installation. A solution to this problem has been, up to now, to connect the gasification installation to the existing water drainage system, but this approach entails a serious risk of obstruction in the conduits of the water drain.

SUMMARY OF THE INVENTION

The object of the present invention is to ensure that the evacuation of slag and water is free from trouble. This is achieved, according to the invention, by interposing across the stream of water and slag a receptacle for separately collecting the slag particles having a larger sinking weight than water and/or a separator for gathering the lighter and floating particles. These receptacles and separators substantially eliminate the slag from the water particles so that water can flow without hindrance into the existing drainage system, or through a closed circuit, when it is recycled and fed back into the water bath of the gasification reactor, or of the associated waste heat boiler. At the same time, the separated slag can be collected in pure form; e.g., without being mixed with any product residue. As a result, it becomes possible to use profitably the falling slag in many ways.

More specifically, in accordance with the present invention, provision is made for a water container serving as a collector and/or as a separator. Such container has a water inlet debouching below, or above, the water surface. There is provided at least one outlet for the clean water and an outlet for the water charged with floating slag, these two outlets being separated from each other by a partition, or wall, projecting into the water. With such an arrangement, the water entraining the slag particles is forced along a predetermined path, while the floating slag particles are lifted and deviate from the main stream following a predetermined but different trajectory upward. Thus, separation of the floating particles is readily achieved.

The non-floating particles proceed downward with the stream of water and are entrained to the bottom of the container where they collect. As a result, clean water can flow toward a definite section of the container where it is available for future use, for instance, to be recycled by being pumped back into the water bath.

The water charged with floating slag goes to another section of the container having an outlet in the form of a dam, a waterfall. If the stream of water is sufficiently low, the floating particles are held back by the dam where they collect. In the alternative, collecting of the floating particles can be achieved independently from the flow velocity by having a filter disposed at the outlet of the container. A permanent filter, or a dam, in either instance, will cause an interruption of operation. After a while, the filter becomes blocked; e.g., the cross-section of the stream of water encounters too large a resistance. As to the dam, it becomes filled with slag particles which are then entrained over the dam. Its role as a separator comes to an end.

An arrangement substantially free from interruption is achieved with a movable filter, in particular a drum, or with an inclined filter. The drum can be used in different ways and it can serve different purposes. The drum, by its motion, serves to stir the water. The water runs through the drum to the outside, and the evacuation is accelerated by the centrifugal force imparted to the water when the drum is in rotation. As a result, a particularly high degree of dryness is achieved with the filtered out slag. When the drum is disposed at an angle, the flow of particles proceeds from one end of the drum to the other. Rotation of the drum and the degree of dryness are reduced because of the necessity of moving the particles, usually through the drum. If the drum turns too fast, the particles under the effect of the centrifugal forces will remain in the drum.

In another operating mode of the drum filter, the water is directed from the outside. The water carrying slag particles is spilled on top of the drum. Water passes through the filter into the inner chamber of the drum and flows out at the bottom, while the slag particles proceed around the drum filter and are continuously evacuated after impact onto a separator plate. If the separator plate is given a certain inclination, the slag particles by gravity slide from the separator plate, which acts as a slide, into a collector. Preferably, the separator plate oriented parallel to the longitudinal axis of the drum coextensively with the filter.

The water duct can be built in the same way. In such case, the water duct may consist of a guide plate which, like the separator plate, extends along the filter of the drum. It is preferable for good operation that both plates be disposed on two opposite sides of the filter; e.g., be opposite relative to the vertical plane of the drum, and that they be at an angle to each other which, however, is relative to the axis of the drum and the tangential point on the filter of the drum is never larger than 90°. Then, the slag particles will make only a very light impact on the drum and will be carried further onto the separator plate, whereas the water will remain free to flow away.

With a fixed and inclined filter, the problem is solved by using a simpler construction. Water is poured onto an inclined filtering plate. The water flows through the filter and is taken away below it, while the slag particles run upon the filtering plate and are leg to a collecting container.

According to a further embodiment of the invention, several of the aforementioned receptacles are arranged in cascade one behind the other. As a result, the slag particles can be automatically classified. If several containers of the same characteristic are arranged in parallel, the overall water and slag output becomes a multiple. Classification of the falling particles is of particular advantage for slag recycling. It permits a precise selection of the desired grain of slag.

For recycling, each container is provided with a duct leading directly into the reactor. If the containers are connected in cascade, the ducts leading to the reactor are connected in parallel. The ducts are simple pipes.

Recirculation of the particles is achieved preferably with pumps working by piston or membrane action. Control of the circulation of the stream of particles is achieved with control valves disposed in selected ducts or in all of them. The control valves need only be dampers placed across the tubes.

Classification of the falling slag particles in the several containers is obtained by choosing different filter apertures or it can result from a difference in the sinking weight and water flow velocity. According to the invention, the difference in the sinking weight of the particles between two adjacent containers mounted in cascade is at least 0.5 g/cm$^3$. Water velocity amounts to at least 2 m/sec.

DESCRIPTION OF THE PREFERRED EMBODIMENTS OF THE INVENTION

Figure 1:
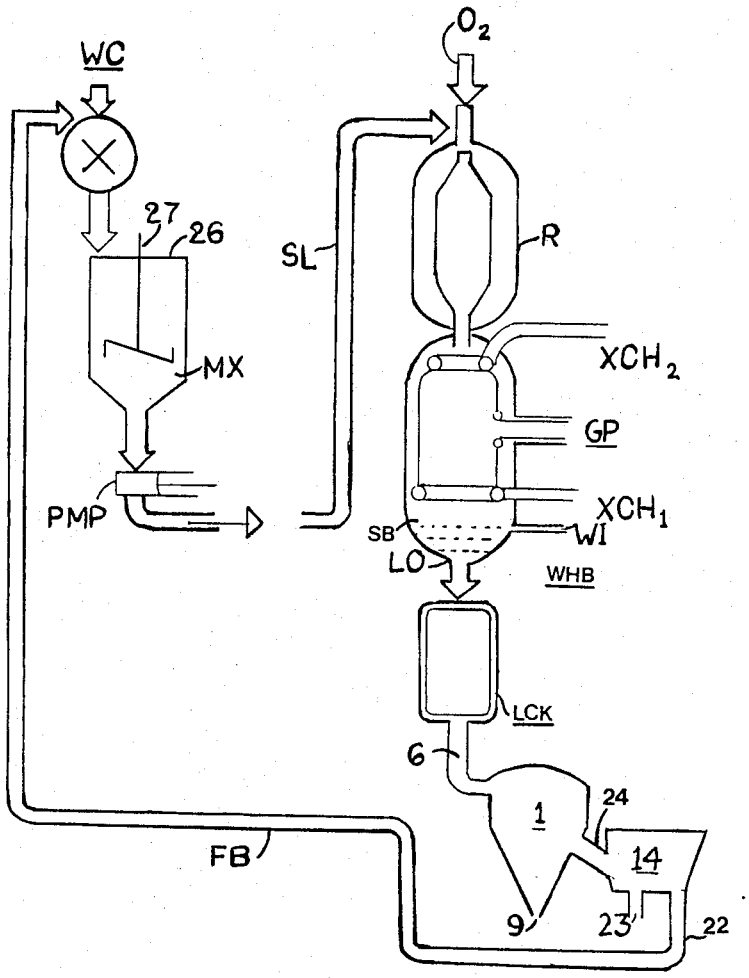
FIG. 1 is a schematic representation of a coal gasification installation including gasifier reactor, slag discharge, and slag recycling.

Referring to FIG. 1, a typical coal gasification installation includes a reactor R and a waste heat boiler WHB which generate synthesis gas by reaction between steam, oxygen and coal inside the reactor, which experiences cooling through a heat exchanger inside the waste heat boiler. The heat exchanger has an inlet $XCH_1$ and an outlet $XCH_2$ for the gas product exhaust at GP. The reactor R is charged at the top with a slurry of coal and water via conduit SL and oxygen is also admitted at the top. Pulverized coal is mixed with water in a mixer MX and the slurry is pumped through conduit SL. At the bottom of the waste heat boiler is a water bath SB acting as a seal between the ambient pressure and the pressure in the reactor thereby preventing the gas product from escaping in the atmosphere. In the water bath SB, slag formed in the reactor R and waste heat boiler WHB falls and collects in front of a lower opening LO which is normally closed. A lock LCK is adjacent to opening LO which is opened when water and slag are being removed, while water is being maintained at the proper level by a water supply WI to the bath. The lock LCK is alternatively filled up and emptied to provide a continuous removal of the slag from the water bath SB.

In accordance with the present invention, a container 1 is connected via conduit 6 to the lower end of lock LCK. Its purpose is to separate heavier slag particles from the lighter ones. The heavier slag particles are removed at the bottom 9 of container 1, the lighter particles are removed via a lateral conduit 24. Also, in accordance with the present invention, a filter separator 14 may be used to separate water from the particles of conduit line 24 which have been separated. Clean water is removed by line 23, and the separated particles are fed back via lines 22 and FB to the mixer MX for further combustion with the coal of the slurry being charged into the reactor R. The invention also provides for combining several filter separators such as 14 in cascade in order to classify the separated particles, as will be seen from the description hereinafter.

To summarize, water charged with slag is taken away through the lock LCK from the water bath SB of the waste heat boiler WHB. The gasifier reactor and the waste heat boiler WHB are generally cylindrical in shape and are fluidly connected, so that slag particles falling vertically from the reactor R come down into the waste heat boiler WHB below, where they experience a fast-cooling operation. The gas product resulting from coal gasification and the accompanying slag particles impinge against the water surface of the water bath SB. At this point, the gas is deflected by the water surface, whereas the particles, due to their inertia, penetrate into the water bath SB and by gravity tend to collect within and at the bottom of the bath water.

The slag particles are removed from beneath the waste heat boiler WHB together with water. This is accomplished by taking advantage of the internal pressure of the reactor R and waste heat boiler WHB during coal gasification while using the lock LCK. Thus, the lower end of the waste heat boiler WHB which connects with the upper end of the lock LCK is first opened. As a result, slag at the bottom of the waste heat boiler WHB passes into the lock LCK. Once the slag particles have left the water bath SB, the fluid connection is closed; e.g., at the upper end of the lock. In the process, only so much water is admitted into the lock LCK as necessary to fill it up. More water remains in the water bath SB, for safety reasons, which is effective to seal off the waste heat boiler WHB containing the gas product. Thereafter, at the lower end of the lock LCK a door is opened, thereby discharging the slag and the water from the lock LCk under the effect of atmospheric pressure, or under some pressure slightly above.

The lock LCK has a double purpose. First, it is a pressure lock. As such it enables the slag to be extracted from the pressurized chambers of the reactor R and the waste heat boiler WHB. Secondly, it protects the gas product from being mixed with the ambient; e.g., thus preventing contamination of the environment from any escaping synthesis gas.

Figure 2:
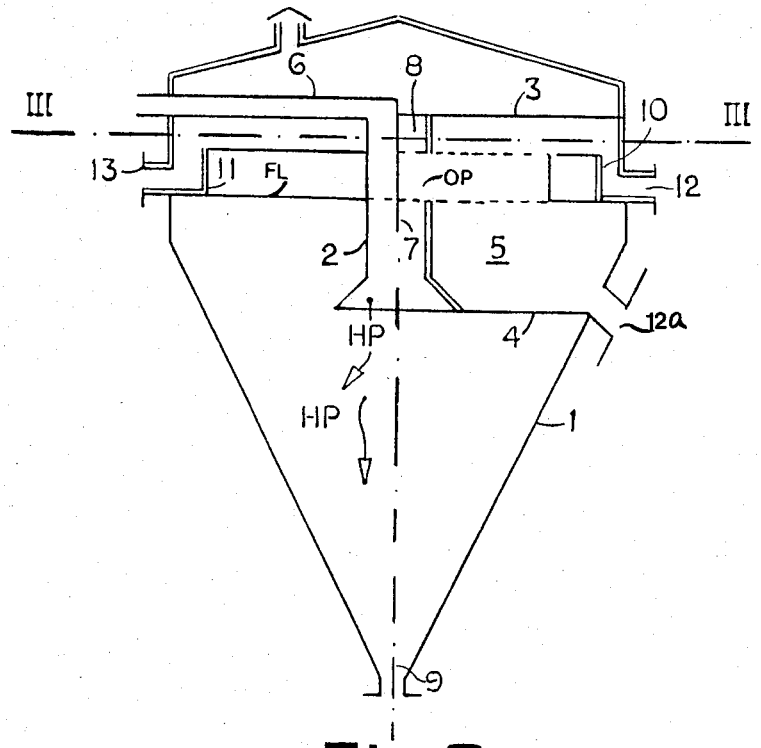
FIGS. 2 and 3 show a container according to the invention embodying both a breaker and a separator.
Figure 3:
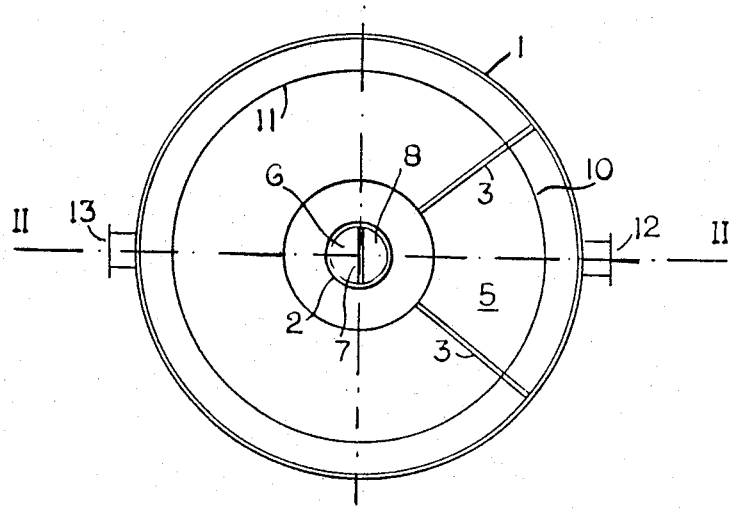

Referring to FIGS. 2 and 3, the container according to the invention is shown in the form of a funnel 1. Funnel 1 is vertical with its narrow end downward. Both ends are open. A tube 2 extends from the upper end of funnel 1 down to the center. Tube 2 is supported inside the funnel by sidewalls 3 or plates which are sealed to the tube 2 and extend radially from it over its entire length and are, at the opposite edge, sealed to the inner wall of the funnel 1 along a coextensive length. Accordingly, the sidewalls 3 are welded to the inner wall of the funnel 1 and to tube 2. The lower edge of sidewalls 3 is connected to a bottom floor 4. The bottom floor 4 is sealed to the sidewalls 3, tube 2 and the inner wall of the funnel 1. Preferably, it is welded all along to those parts. Bottom floor 4 completes a receptacle 5 defined by the sidewalls 3, the portion of tube 2 encompassed by the sidewalls 3, the bottom floor 4, as well as the inner wall of the funnel delineated between the sidewalls 3 and the bottom floor 4.

The water charged with slag which has been taken away from the water bath SB of the waste heat boiler WHB is forced under pressure through inlet 6 into tube 2 of funnel 1, for instance, with the assist of a paddle wheel, or a piston pump.

Tube 2 possesses a separating wall 7. Separating wall 7 separates the inner space of the tube 2 into two halves ending toward the middle of tube 2; e.g., the wall extends along half of the length of tube 2.

In practice, the water receptacle is specifically designed so as to fit the purpose and provide the desired functions. Thus, in an arrangement requiring a simpler construction, tubes are used for the admission of water and a wall is provided for separating the floating from the non-floating particles. The tubes may be connected to each other or be formed as one piece. They may be disposed concentrically to one another. The tube possessing the separating wall debouches into a closed collecting container for collection of water and floating slag particles. Such collecting container may be disposed inside the receptacle used to separate the floating from the non-floating particles.

The slag particles, which emerge with the water from inlet 6 and are forced by pumping downward into tube 2, have different sinking weights. Those which, relative to water, have a smaller sinking weight, are able to float. Therefore, these particles have a tendency to rise. This tendency to rise at first is overcome by the pressure of the pump from inlet 6. When they reach the lower edge of the separating wall 7, the floatable slag particles have the opportunity to break away from the steam and to rise in the opposite direction, upward, through the other half of the tube 2 as indicated by reference numeral 8. Then, the floatable particles succeed in getting out of tube-half 8 and reaching through an open space OP the collecting receptacle 5. On the other hand, the slag particles having a sinking weight larger than water, as they emerge from tube 2 downward, follow a trajectory toward the lower end of funnel 1. At the lower end 9 of funnel 1 these heavier slag particles collect. From there, they can be removed continually or from time to time. The water fed from inlet 6 accumulates and flows over a dam 10 provided in the collecting receptacle 5 and a second dam 11 provided in the other portion of the funnel, with respective outlets 12 and 13. The water leaving through outlet 13 is free from slag particles which have gathered at the lower end of funnel 1. The water leaving through outlet 12 is cleaned from the floating particles due to the effect of dam 10. Dam 10 stops and retains the floating slag particles. Dams 10 and 11 are provided by a common ring-plate mounted inside funnel 1. The ring-plate is divided into two segments by the sidewalls 3. Typically the ring-plate has a floor FL at the base of the dam 10 or 11.

The accumulation of floating particles behind dam 10 and in collecting receptacle 5 requires repeatedly to clean and empty the collecting receptacle 5 by means of an outlet 12*a*. It is possible that, when the receptacle 5 has been filled, an excess of slag particles will flow over the dam 10 and be entrained by the water onto outlet 12. As explained hereinafter, both outlets 12 and 12*a* may be connected to a filter which may be in the form of a drum like shown in FIGS. 4 and 5.

Figure 4:
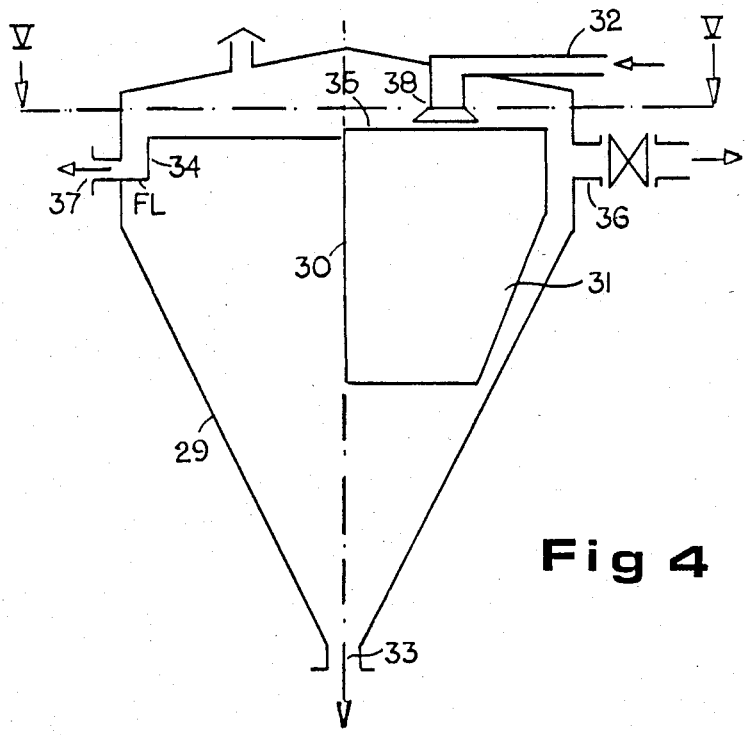
FIGS. 4 and 5 show a container according to the invention in which the combination of a breaker and a separator includes an open zone of separation.
Figure 5:
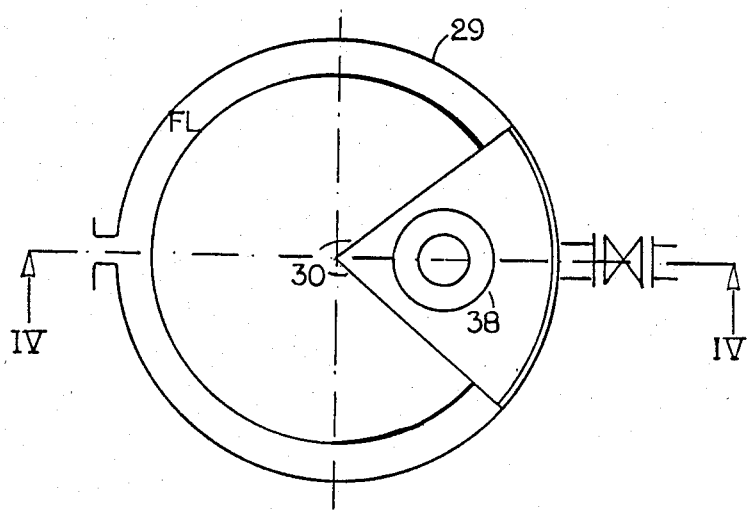

Referring to FIGS. 4 and 5, a container according to another embodiment of the invention, comprises a funnel 29. Funnel 29 is vertical with its narrow end downward and an opening or outlet 33 at this end. A vertical tube 38 is mounted eccentrically at the upper end of funnel 29. Tube 38 is disposed so as to debouch right above an open separator zone 31. This separator zone 31 is defined by two sidewalls 30 which are welded to the wall of the funnel all along from edge to edge.

An inlet 32 feeds laterally into vertical tube 38 water which, like in the first embodiment, is loaded with slag. The water which entrains the slag is pumped through inlet 32 into tube 38 under the pressure of, for instance, a paddle wheel or a piston pump.

Water and slag coming out of inlet 32 are discharged from tube 38 and reach directly the surface of the open separator zone 31 which is filled with water. Certain particles can float because they have a sinking weight which is less than water. These have a tendency to remain afloat, thus, are prevented from leaving the open separator zone 31 over the dam 35 defined by sidewalls 30 and from reaching an outlet 37 outside the open separator zone 31. At this point, there is clean water due to the separating effect caused by dam 35 along the sidewalls 30 which are higher than the surface of the water on the other side. Outlet 37, like outlet 13 in the embodiment of FIG. 2, is situated after and below a dam 34. The slag particles having a sinking weight which is larger than water, after they leave tube 38, sink below the surface and proceed along a trajectory downward through the open separator zone 31, until they reach opening 33 at the lower end of funnel 29. These heavier particles accumulate there, where they can then be removed continuously or from time to time. The water coming from inlet 32 flows over dam 35, then over dam 34 and reaches outlet 37.

The water flowing through outlet 37 is cleaned from any slag particles which either have collected at the lower end 33 of funnel 29 or as floating particles have gathered in the open separator zone 31. Such gathered floating particles may be removed continuously or from time to time via an outlet 36. It is possible also to provide a rake actuated mechanically for raking away the floating particles of the open separator zone 31.

Figure 6:
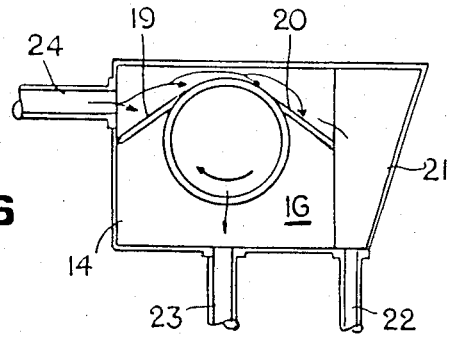
FIGS. 6 and 7 show details of a container in another embodiment of the invention.
Figure 7:
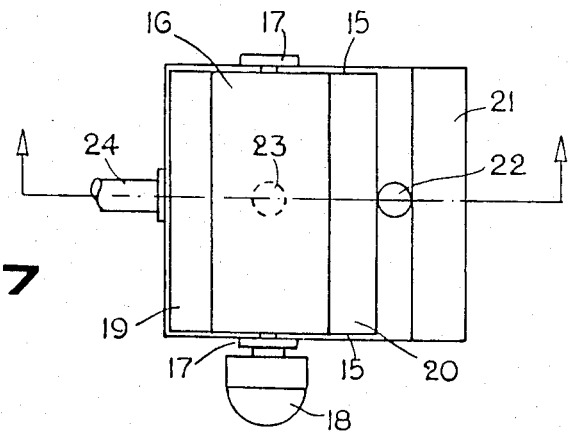

Referring to FIGS. 6 and 7, apparatus is shown which can be substituted for the overall funnel 1 of FIGS. 2 and 3 or which can merely replace the collecting receptacle 5 of FIGS. 2 and 3. The apparatus of FIGS. 6 and 7 comprises a container 14 built as a box and a drum filter 16 mounted for rotation in the sidewalls 15 of container 14. The drum filter 16 is held at both ends by bearing-flanges 17 and is driven on one side by a motor 18. Motor 18 drives the drum filter 16 at uniform speed. The drum filter 16 is flush with two plates 19 and 20. Plate 19 serves as a reception plate, whereas plate 20 is a slide plate. Slide 20 leads to a funnel 21 having at its lower end an outlet, or conduit 22, the purpose of which is to evacuate the slag particles collecting on slide plate 20. Similarly, at the bottom of container 14 an outlet, or conduit, 23 is provided. The purpose of conduit 23 is to evacuate the water after it has passed through the drum filter 16. Container 14 includes also an inlet 24 for the admission under pressure of water charged with slag.

In operation, water which entrains slag particles is pumped through inlet 24 into container 14. The water and slag particles reach the top of the reception plate 19 from the left and flow around the drum filter 16 as it is rotating slowly clockwise. Thus, the drum filter 16 forces the slag particles to proceed from the reception plate 19 to the slide plate 20, whereas water passes directly through the filter and falls to the bottom of the container 14 where it is removed through conduit 23.

The slag particles reaching slide plate 20 are pushed away from the drum filter 16 and they glide from slide plate 20 into funnel 21, where they collect and are removed through conduit 22 continuously, or from time to time, for further use.

In order to assist in having the slag particles pushed away from the drum filter 16, the slide plate 20 is disposed so as to nearly touch the drum filter 16; e.g., it is mounted on the drum filter 16 with only a very small gap. The same applies to the reception plate 19, in order to prevent any undesirable escape of slag particles directly toward the bottom of the container 14.

The rotating speed of the drum filter 16 and the velocity of the flowing water and slag particles are so related that the level of the water accumulated on the reception side remains below the level defined by the upper envelope of the drum filter 16.

In order to maximize the degree of dryness of the slag particles obtained in this separation process, it is possible to provide filtering apertures in the slide plate 20, thereby allowing a further elimination of the water collecting on the slide plate 20.

It is also possible to give the filter the form of a slide rather than a drum-like filter 16. Then, without any drum filter 16 or reception plate 19, the slide plate 20 will be used as a filter extending from the funnel 21 to the inlet 24.

Moreover, instead of spraying the drum filter 16 with water charged with slag from the outside, this can be done, in the alternative, from the inside. In such case, the drum filter 16 is built as a hollow cylinder and the water with entrained slag is deflected from an inlet pipe 24 disposed coaxially inside the drum filter 16. Then, water passes through the drum filter 16 and emerges into the surrounding container 14. Rotation of the drum filter 16 accelerates the separation process between the water and the slag particles. The water coming out is projected on all sides against the side-walls 15 of the container 14 and it flows along the side-walls 15 down to the bottom of the container where it is removed through conduit 23.

In the drum filter 16 the separation process is continuous; e.g., the slag is freed from the water continuously and it comes out at the other end of the drum filter 16. When the container 14 has a drum filter 16 which is inclined instead of having, as shown in FIG. 5, the motor and the shaft on the same level, the motor is remotely disposed and coupled by means of a suitable transmission; pulley or cog-wheel, for instance. The pulley, or cog-wheel transmission, allows the drum filter bearing to be outside the confines of the drum-filter 16, while the driving wheel is disposed outside the container with an opening encompassing the inner dimensions of the drum filter 16. As a result, the slag particles are able to come out on a flat surface without hindrance from the drum filter 16 and through the driving wheel. The water charged with slag can be led through a coaxial aperture of the shaft belonging to the bearing flange 17.

The rotating speed of the drum filter 16 should be limited when spraying is from inside. This is due to the effect of the centrifugal forces and the inclination of the drum filter 16 or the container 14.

When a sorting container 14 replaces the entire funnel 1, much as the one of FIGS. 1 and 2 instead of at 4 or 5, the slag particles collect in funnel 21. The container 14 in which the slag particles collect is axially disposed relative to the drum filter 16, while the slag particles travel through the drum filter 16 axially.

When classification of the slag particles if required, a sorting container 14 is substituted for the collector container of FIGS. 1 and 2. Then, inlet 24 is connected with the funnel or container 1, and the lighter slag particles are removed via the lateral conduit 24, and, the slag particles having a larger sinking weight will collect in funnel 1 while slag particles with smaller sinking weights will collect in funnel 21. Further classification of the slag material is achieved by changing the velocity of the flow of water and/or the filtering apertures of the drum filter 16, or of the slide plate 20. Increasing the velocity of water leads to more small particles being entrained over the dam 10. With a cascade arrangement of several collector and separator apparatus, the overflown slag particles are collected into a subsequent collector, or separator receptacle. Thus, such continuous classification rests upon changing certain characteristics of the separator or collector which preceeds in the chain. An excessive water velocity will cause a diminution of the collector and separator capability of the particular equipment at a given stage.

Independently of water velocity the classification process can be modified by selecting different filter openings. When large filter openings are close to each other, the slag particles of small size will be able to pass with the water through the drum filter 16 or the slide plate 20. Then, only the larger particles will be treated by the collector and separator apparatus ahead of it. The smaller particles which have been entrained with the water can be separated further down by one or more collector and separator apparatus connected in cascade. If the filter openings are graduated in size from apparatus to apparatus, the slag particles are sorted out according to size.

Figure 8:
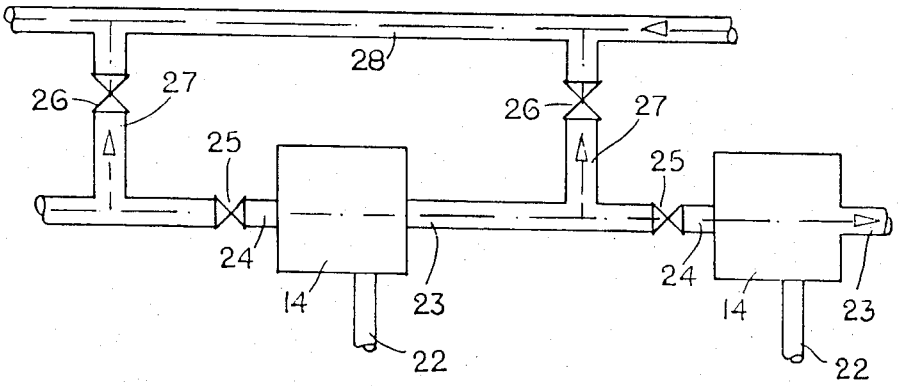
FIG. 8 shows several containers like those of FIGS. 2 to 5 mounted in cascade coupled with recycling of the slag into the reactor.

FIG. 8 shows several separators and collectors in cascade. The diagram relates to equipment such as container 14 of FIGS. 6 and 7 several mounted in cascade. In each conduit 24 a control valve 25 is mounted which, in the drawing, is illustrated as a damper. Each container 14 has its inlet 24 connected to the outlet 23 of a preceding container 14. Each conduit 23, 24 is connected via a conduit 27 having a control valve 26, to a parallel conduit, or by-pass 28. Each control valve 25 controls the admission to an associated container 14. Depending upon valve adjustment, more or less of the slag containing water is admitted into container 14. The water prevented by the control valve from entering the container 14 flows with the slag particles through the adjacent conduit 27 and via control valve 26 into the by-pass conduit 28. On the other hand, the stream of fluid in conduit 27 can be modified by adjustment of control valve 26.

With filter openings of different sizes for each container 14, the larger filter openings being encountered first and becoming smaller from container to container, water comes out from each container with entrained particles of smaller size. Such water and smaller particles can be diverted and by-passed in totality, or in part, through adjustment of the control valve 26 into the branching conduit 27 to the parallel conduit 28.

The stream of water and particles separated from the remaining water and particle stream, once it reaches the subsequent container 14 is again freed from particles of a certain size; namely, those which are held back by the filter openings of the corresponding container 14. The particles of smaller size entrained by the water come out through outlet 23 and can be totally or in part led to the parallel conduit 28. This is achieved with the assist of the control valve 25 connected ahead of the subsequent container 14.

The filtered particles are discharged by respective conduits 22 from all containers 14. The filtered particles can be used for various purposes.

The slag particles passing with the water in parallel conduit 28 have a grain size distribution which has been so adjusted by control valves 25 and 26 that they add up in an optimal fashion with the charging coal. They are fed back via the parallel conduit 28 into the coal loader, in particular into the mixer connected before the gasification reactor. Such optimal adjustment is achieved by hand through testing and by adjustment of the control valve 25.

The slag particles are fed into the mixer with the water, when the charging coal must be in the form of a pumpable coal-water slurry. Moreover, the water content from the parallel conduit 28 can be reduced at will by interposing an additional container such as the one of FIGS. 2 to 5. Such reduction is due either to a correspondingly reduced capability of water separation or a partial addition of separated water after leaving the separation container.

Preferably, recycling of slag particles into the reactor is limited to floating particles. The floatable particles lend themselves to further use with the coal because of incomplete combustion.

Since an additional mixing of slag particles which are fully burnt is of advantage to regulate the reactor temperature, an additional admission of particles coming from funnel 1; e.g., its lower end, is provided with the parallel conduit 28. This additional admission is achieved with a specially designed feeding arrangement; a screw pump, for instance.

What is claimed is:

1. In a coal gasification installation having a gasifier reactor and a water bath below the reactor for collecting slag from the reactor wherein a mixture of water and slag particles is derived from said water bath, a slag separator connected for sorting said water and slag mixture into heavier, non-floating, slag particles and lighter, floating slag particles, said separator comprising a container to be filled with said water and slag mixture for receiving under pressure said water and slag mixture from an upper inlet, said container having:

at least one water discharging side outlet, a lighter slag particle discharging side outlet, and a heavier slag particle discharging lower end outlet, partition means disposed in said container and extending in operation in water and separating said at least one water discharging side outlet and said floating particle discharging side outlet for separating said floating slag particles from the water, substantially clean water being discharged through said water discharging side outlet, wherein separated floating slag particles are discharged at least in part through said lighter slag particle discharging side outlet, said partition means forming a compartment in said container for accumulating said floating particles, said partition means including a dam, said partition means being disposed to allow said substantially clean water, during operation, to flow over said dam of said partition means and out through said at least one water discharging side outlet, and also to retain said lighter floating slag particles within said compartment, said upper inlet being disposed to admit said slag and water mixture flow into said water from above, at least a conduit connecting said upper inlet to said water bath, said inlet connected to a tube extending into said container, a wall being disposed in said tube for guiding said heavier slag particles downwardly toward said heavier slag particle discharging lower end outlet and also for guiding said lighter, floating, slag particles underneath said wall into said compartment for accumulating said floating particles for discharge through said lighter slag particle discharging side outlet, and feedback means for feeding back said lighter slag particles into said gasifier reactor.

2. The coal gasification installation of claim 1 wherein said tube extends vertically into said container; with said compartment being defined by side walls welded to said tube.

3. The coal gasification installation of claim 2 wherein said compartment has a bottom for defining a substantially closed chamber for said lighter, floating, slag particles.

* * * * *